US008133037B2

(12) United States Patent
Fischer et al.

(10) Patent No.: US 8,133,037 B2
(45) Date of Patent: Mar. 13, 2012

(54) EXTERNAL GEAR HYDRAULIC PUMP WITH ACOUSTICAL INSULATION

(75) Inventors: Francois Fischer, Bry sur Marne (FR); Laurent Graissaguel, La Varenne Saint Hilaire (FR); Nicaise Lesther, Creteil (FR)

(73) Assignee: JTEKT HPI, Chennevieres sur Marne (FR)

( * ) Notice: Subject to any disclaimer, the term of this patent is extended or adjusted under 35 U.S.C. 154(b) by 666 days.

(21) Appl. No.: 12/247,313

(22) Filed: Oct. 8, 2008

(65) Prior Publication Data

US 2009/0097992 A1 Apr. 16, 2009

(30) Foreign Application Priority Data

Oct. 12, 2007 (FR) ..... 07 58289

(51) Int. Cl.
*F04B 39/00* (2006.01)

(52) U.S. Cl. ..... 417/312; 181/252

(58) Field of Classification Search ..... None
See application file for complete search history.

(56) References Cited

U.S. PATENT DOCUMENTS

| | | | | | |
|---|---|---|---|---|---|
| 3,936,238 | A * | 2/1976 | Wycliffe | 417/312 |
| 4,093,406 | A * | 6/1978 | Miller | 417/401 |
| 5,332,371 | A * | 7/1994 | Dantlgraber et al. | 417/363 |
| 5,591,015 | A * | 1/1997 | Dantlgraber | 417/312 |
| 6,004,119 | A * | 12/1999 | Hamasaki et al. | 418/181 |
| 6,168,393 | B1 * | 1/2001 | Huber et al. | 417/360 |
| 6,287,090 | B1 * | 9/2001 | Hamasaki et al. | 417/360 |
| 6,305,919 | B1 * | 10/2001 | Staton et al. | 417/540 |
| 6,309,187 | B1 * | 10/2001 | Robertson et al. | 417/312 |
| 7,743,694 | B2 * | 6/2010 | Becker | 92/71 |
| 2006/0057007 | A1 * | 3/2006 | Bumbel et al. | 417/423.15 |

FOREIGN PATENT DOCUMENTS

| | | | |
|---|---|---|---|
| EP | 1 820 969 | A1 | 8/2007 |
| JP | 2005-133584 | A | 10/2003 |
| WO | WO 2006/053526 | A1 | 5/2006 |

* cited by examiner

*Primary Examiner* — Peter Macchiarolo
(74) *Attorney, Agent, or Firm* — Leydig, Voit & Mayer, Ltd.

(57) ABSTRACT

The invention concerns an external gear hydraulic pump including a pump body housing rotating pinions that mutually engage. Located on opposite sides of the body are a cover and a support, forming an outlet manifold for high pressure fluid. Acoustic insulation elements damp the vibrations produced by the pinions. The acoustic insulation elements acoustically decouple the pump body from the support.

15 Claims, 6 Drawing Sheets

Figure 1:
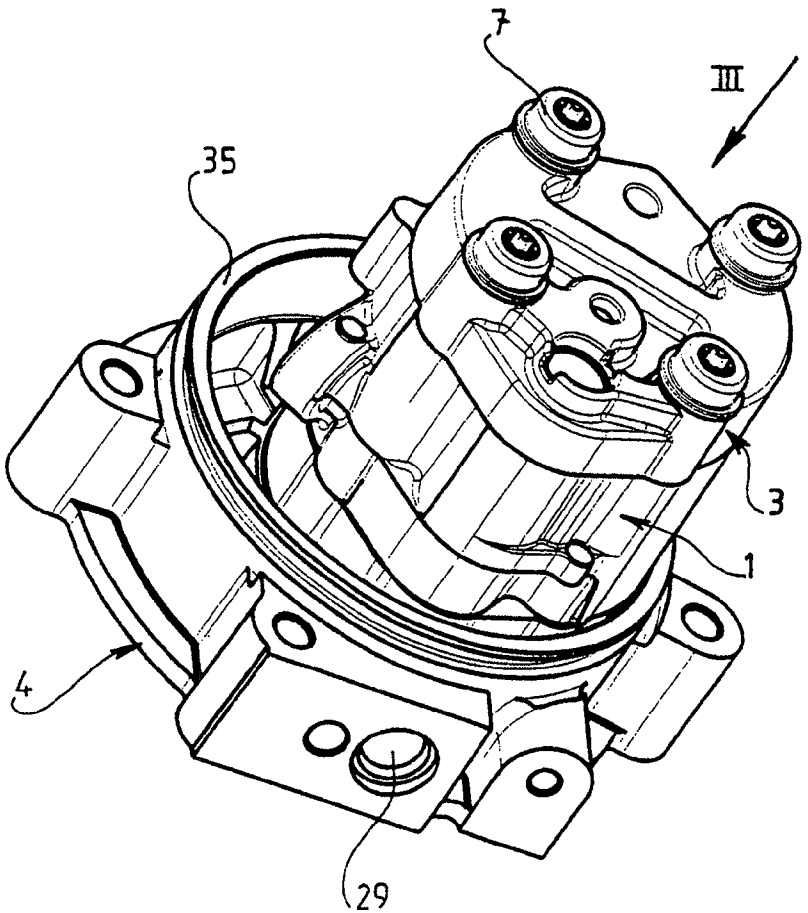

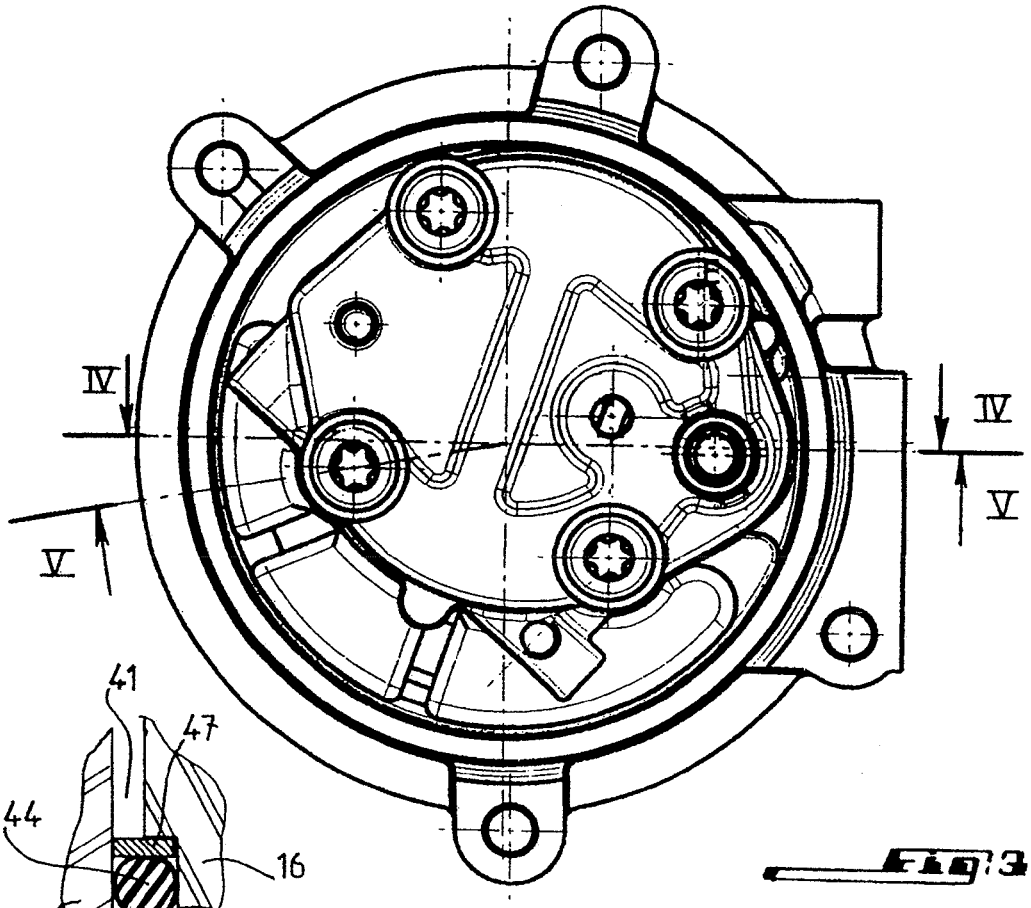
Fig. 3
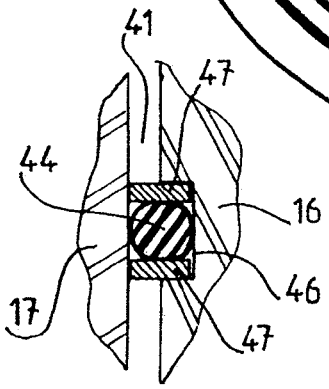
Fig. 11
Fig. 10
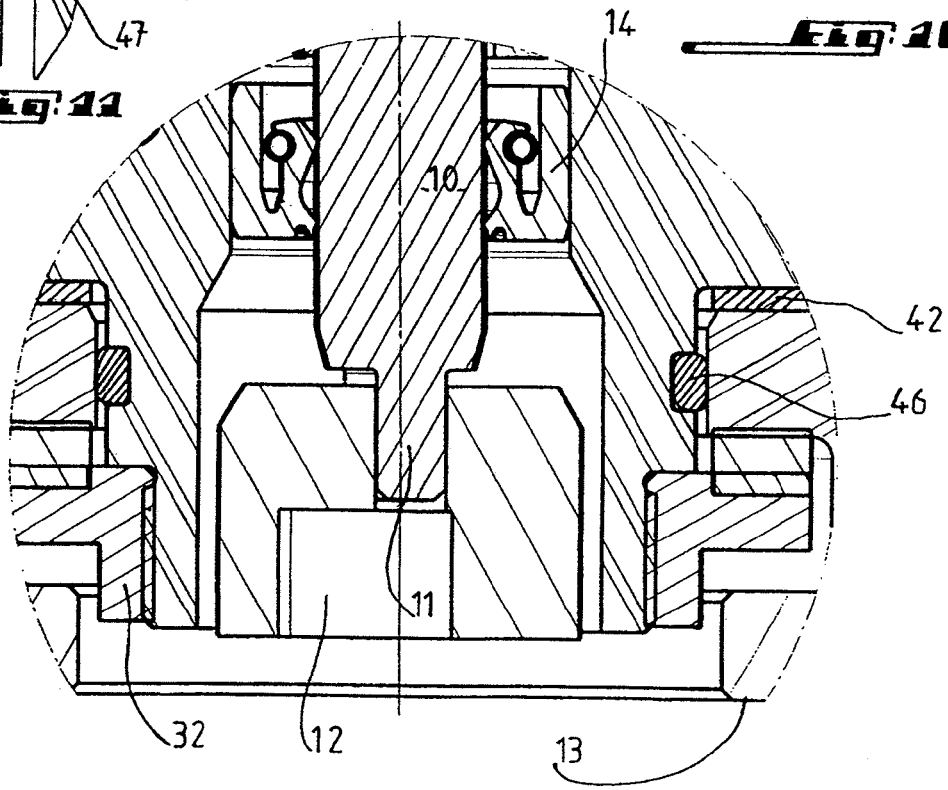

EXTERNAL GEAR HYDRAULIC PUMP WITH ACOUSTICAL INSULATION

FIELD OF THE INVENTION

The invention relates to an external gear hydraulic pump arrangement comprising a pump body including a working chamber housing two rotating pinions that mutually engage, and, on either side of the body, a cover and a support forming an outlet manifold for the high pressure fluid, as well as acoustic insulation to damp the vibrations produced by the pinions.

BACKGROUND

The arrangements of this type which are known provide, as acoustic insulation, an envelope made of a heavy elastomer that encloses the pump. The arrangements provided for such an acoustic insulation envelope considerably raise the manufacturing cost and increase the size of the pump, although, particularly in the automobile industry, the desire is to reduce the space needed for installing pumps.

The purpose of the invention is to overcome these disadvantages.

SUMMARY OF THE INVENTION

To achieve this purpose, according to the invention the acoustic insulation means comprises elements for acoustically decoupling the pump body from its support.

According to a characteristic of the invention, the pump support includes two distinct pieces, one of which is integrally connected to the pump body while the other constitutes a manifold comprising the outlet for the high pressure fluid, and the two pieces are coupled via the interposition of acoustic insulation without physical contact that allows transmission of vibrations.

According to another characteristic of the invention, the support body comprises a face separated from the bearing face of the manifold by an acoustic insulation sheet.

According to another characteristic of the invention, the sheet is an elastomeric material.

According to another characteristic of the invention, the sheet is a multilayered sheet comprising a layer made of metal, and elastomer layers attached to the metal layer, on both sides.

According to another characteristic of the invention, the elastomer layers have different thicknesses.

According to another characteristic of the invention, the elastomer is a nitrile rubber.

According to another characteristic of the invention, the support body comprises connectors projecting from a bearing face, the manifold comprises reception recesses for the connectors and complementary in shape, so that a clearance remains between the facing surfaces of the connectors and the recesses, and the acoustic insulation elements are located on the facing surfaces.

According to another characteristic of the invention, the acoustic insulation elements are O-rings.

According to another characteristic of the invention, at least one reinforcement ring is provided next to an O-ring, to avoid extrusion when the O-ring is located between media at different pressures.

According to another characteristic of the invention, the support body comprises a threaded connector that extends through a recess passing through the manifold, and coupling of the manifold to the support body is effected by a nut and a ring of an acoustically insulating material interposed between the nut and the supporting surface of the manifold.

According to another characteristic of the invention, the manifold is coupled on the support body by a plurality of screws that are anchored in the support body and which have heads bearing against the manifold via washers of an acoustically insulating material.

According to another characteristic of the invention, the pump body is integrally connected to the support body by bolts that are screwed into the support body.

According to another characteristic of the invention, the support body comprises a projecting connector that delimits a space for the passage of high pressure fluid, that opens in an opening of a peripheral surface, and the acoustic insulation elements are respectively located above and below the opening and also constitute sealing elements. The sealing element that is located below the opening, prevents the possibility of high pressure fluid reaching an area under the connector, to ensure a balanced position of a front body in the manifold.

BRIEF DESCRIPTION OF DRAWING FIGURES

Figure 2:
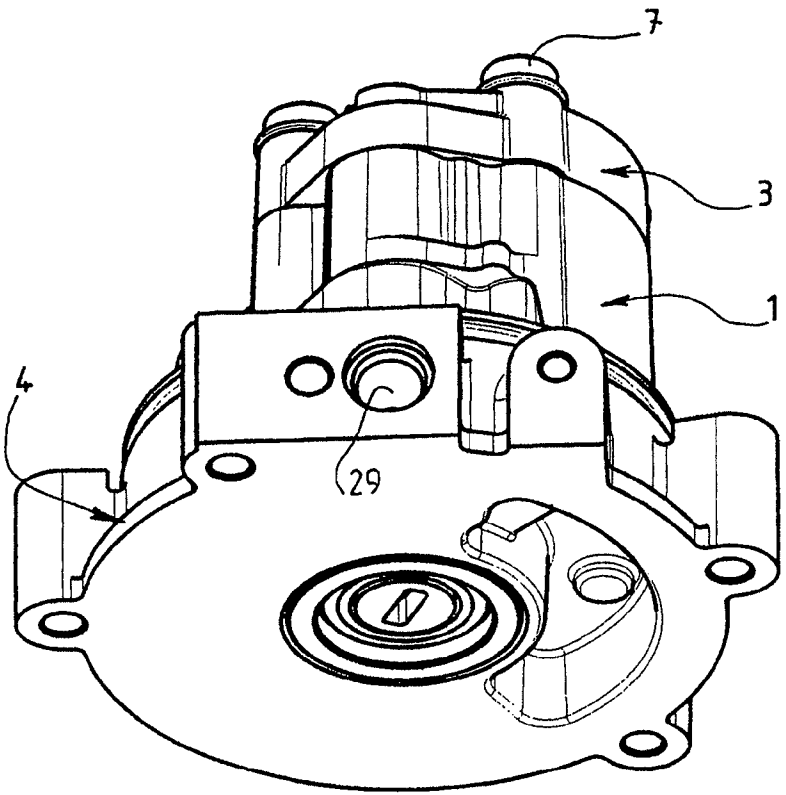
Figure 4:
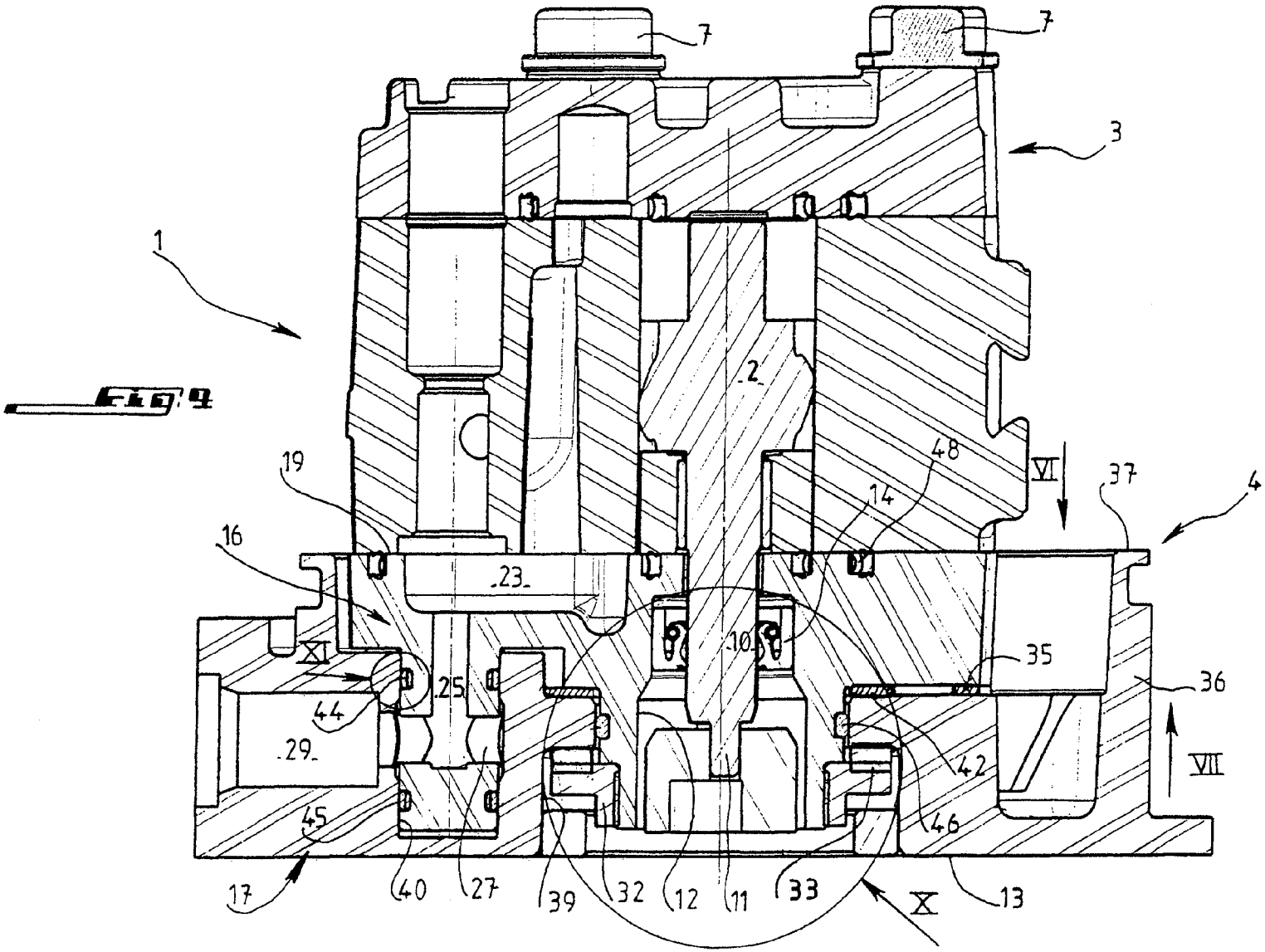
Figure 5:
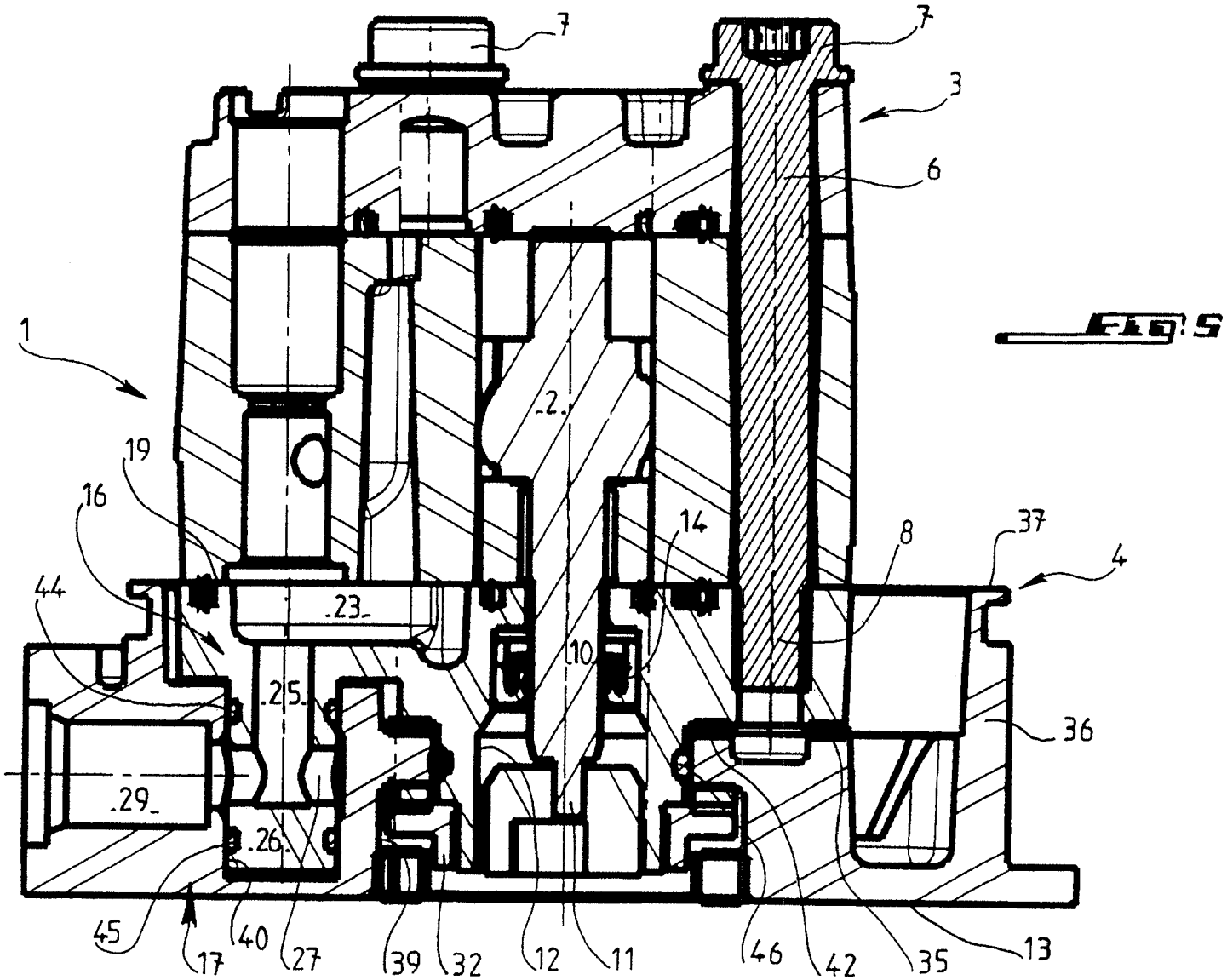
Figure 6:
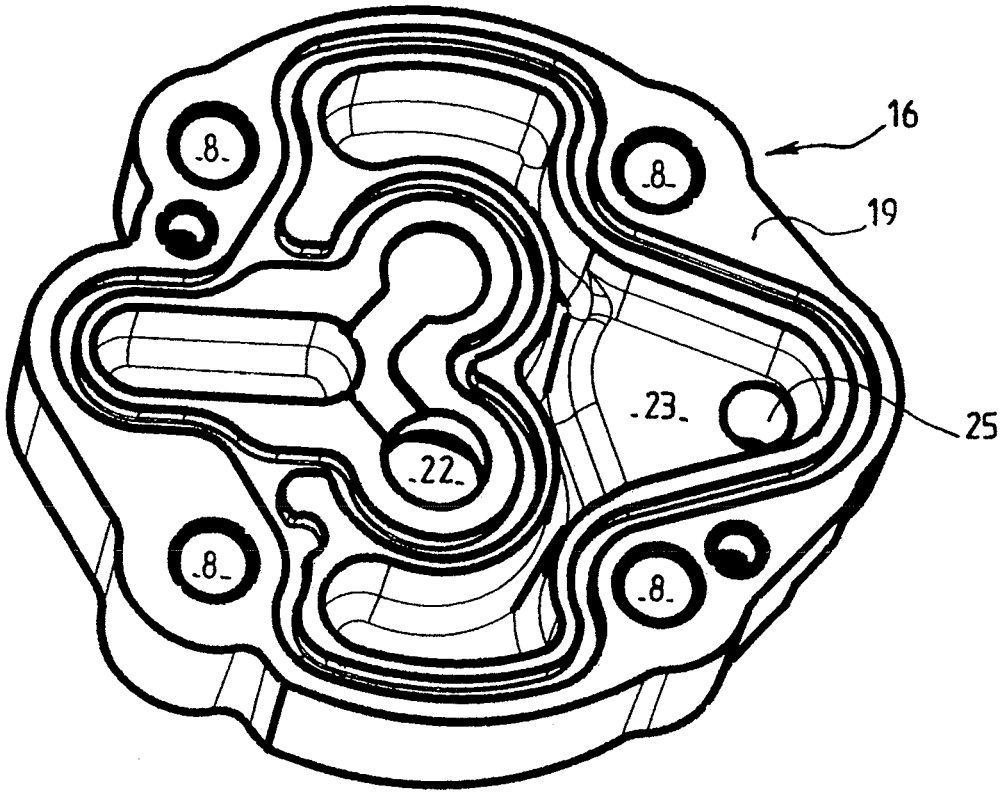
Figure 7:
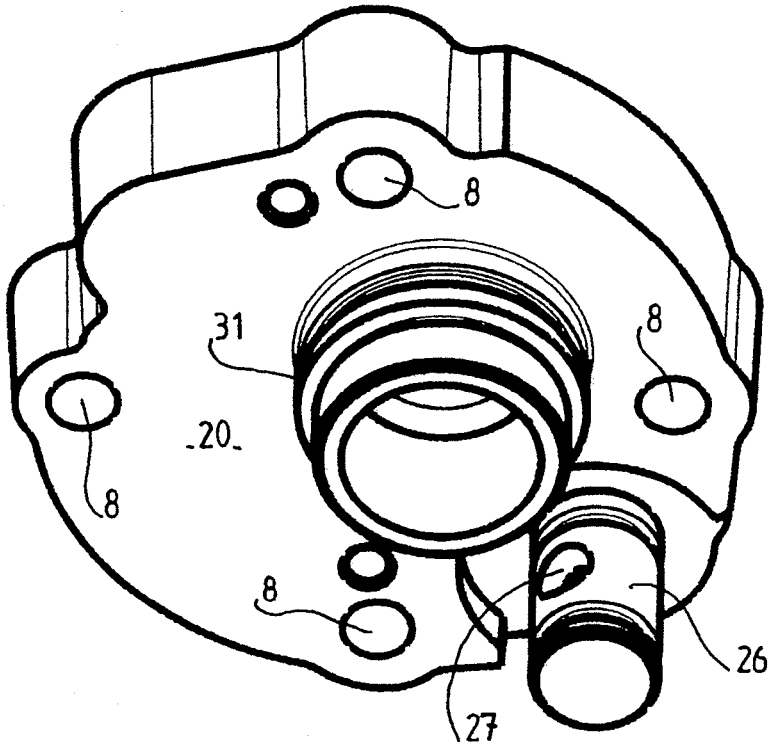
Figure 8:
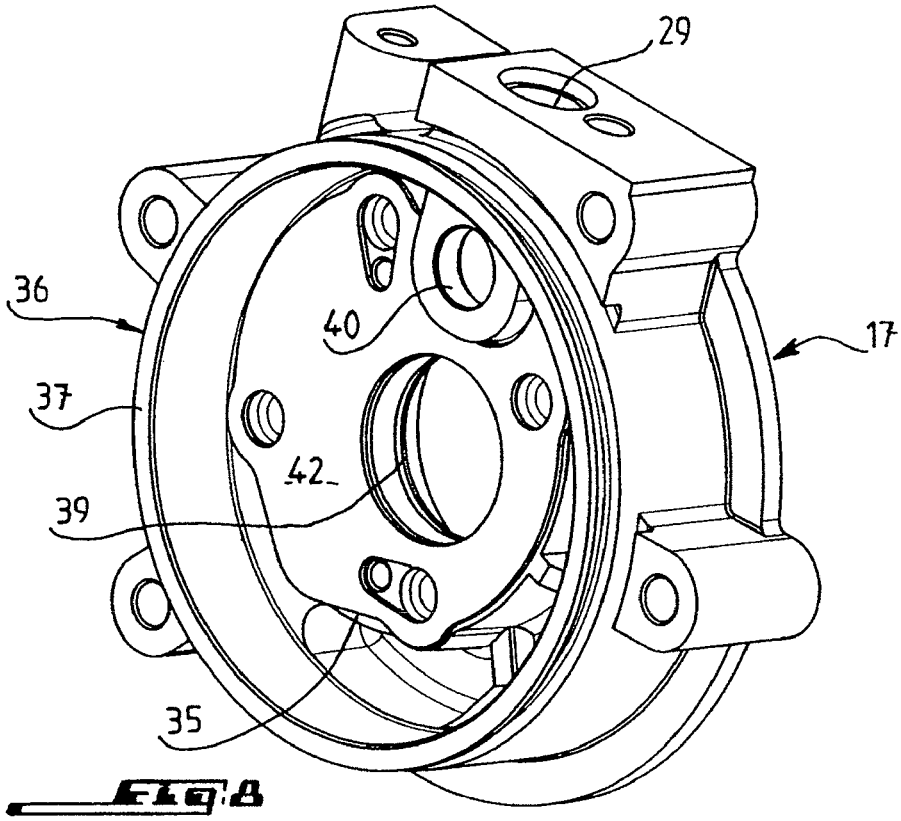
Figure 9:
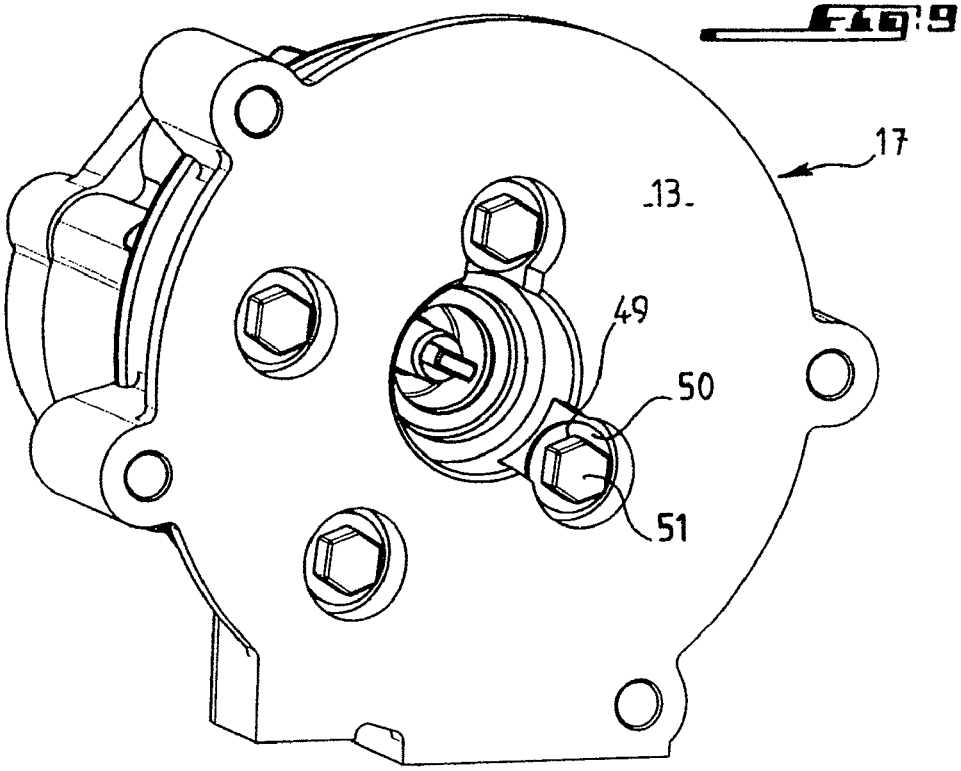

The invention, as well as other purposes, characteristics, details and advantage thereof, will become clearer during the course of the explanatory description below that is made in reference to the schematic drawings, which are given solely as an example illustrating an embodiment of the invention, and in which FIGS. 1 and 2 are two different oblique views of an external gear hydraulic pump arrangement according to the invention, FIG. 3 is a top view of the pump, in the direction of the arrow III of FIG. 1, FIG. 4 is a cross section along the line IV-IV of FIG. 3 in a plane parallel to the axis of the pump, FIG. 5 is a cross section similar to FIG. 4, but along line V-V of FIG. 3, FIG. 6 is an oblique view of the front support body of the pump, in the direction of the arrow VI of FIG. 4, FIG. 7 is an oblique view of the lower face of the front support body in the direction of the arrow VII of FIG. 4;

FIG. 8 is an oblique view of the manifold including an acoustic decoupling element, FIG. 9 is an oblique view of the lower face of another embodiment of the pump support, FIG. 10 is a view of the detail circled at X in FIG. 4, and FIG. 11 is a view of the detail marked XI in FIG. 4.

DETAILED DESCRIPTION

According to the figures, the external gear hydraulic pump arrangement according to the invention comprises a pump body 1 in which is housed, in a known manner, two pinions, of which one is marked 2 and is visible in FIG. 4, a pump cover 3, and a pump support 4, where the latter are attached to end surfaces of the body on both sides of the body.

The assembly of the cover 3, the body 1, and the support 4 is ensured by four bolts 6 having heads 7 bearing against the cover and ends engaged in the threaded holes 8 in the support, as shown in FIGS. 4 and 5. In these figures, one can also see that the pinion 2 is provided with a rotating drive shaft 10 with a drive end 1 that is accessible through an opening 12 in the free lower face 13 of the pump support. A sealing joint 14 is interposed between the shaft 10 of the pinion and the support.

According to the invention, the pump support 4 includes two pieces, i.e., a front support piece 16, on a free face 19 of which the pump body 1 is fixed, and a back support body, called manifold 17, having a free face constituting the lower face 13 of the pump.

FIGS. 6 and 7 are oblique views and, in particular, they illustrate the upper bearing face 19 of the pump body 1 and the lower face 20 on which the manifold 17 is mounted, respectively. FIG. 6 clearly shows the threaded holes 8 with which the assembly bolts 6 are threadedly engaged, a bore 22 for the passage of the pinion driving shaft 10, and a space 23, which is part of the outlet path for the high pressure fluid. The space 23 communicates at a first end with the high pressure outlet of the working chamber (not shown) which accommodates the pinion 3. The space 23 communicates at a second end with a passage 25 located in a cylindrical connector 26 that projects from the lower face 20 of the front body 16 and is closed at its free end. As one can see in FIGS. 4 and 5, this passage 25, which extends axially into the connector 26, communicates through a diametric passage 27 with the high pressure outlet orifice 29 of the manifold 17. FIG. 7 shows that a threaded cylindrical connector 31 projects from the lower face 20 of the body 16, next to the connector 26. This threaded connector 31 is intended to receive a nut 32, for fixing the base 17 to the body 16 inside the central opening 39 in the free external face of the manifold. This bolt 32 bears against a support surface of the manifold via a ring or a washer 33 made of an acoustically insulating material and interposed between the nut and the supporting surface.

The manifold 17 comprises a contact surface 35 for the front body 16, and around this face, a cylindrical external wall 36, which projects beyond the bearing face 35 and has a free front face 37, serves as support face for the placement of a reservoir, not shown, which is known and which delimits, with the internal space of the manifold, the volume that contains the low pressure fluid sucked in by the pump. A central recess 39 for receiving the connector 31 of the front support body 16 as well as a cylindrical recess 40 for receiving the channel connector of the high pressure outlet 26 of the front body are located in the bearing face 35. The opening of the high pressure outlet 29, which is produced in the peripheral surface of the manifold, is in communication with the recess 40.

According to another characteristic of the invention, the front pump body 16 is fixed to the manifold 17, without any direct contact between these two pieces that could allow the transmission of vibrations, produced by the pulses generated by engagement of the pinions, by the front body 16 to the manifold 17. The manifold is thus completely decoupled from the source of the vibrations. For this purpose, an element that is advantageously in the shape of a sheet 42 and made of an acoustically insulating material is interposed between the lower face 20 of the body 16 and the bearing face 35 of the manifold (FIG. 8). The decoupling requires the presence of clearances, as shown at 41 in FIG. 11, between the faces of the recesses 39 and 40 of the manifold and the peripheral surfaces of the connectors 31 and 26, respectively, that are engaged in the recesses. To the extent that the connector 26 comprises a diametric passage 27 for conveying high pressure fluid to the high pressure outlet 29 of the manifold, O-rings 44, 45 are located above and below the diametric passage 27. Another O-ring 46 is located between the central connector 31 and the recess 39 of the manifold. The O-rings are arranged in appropriate peripheral grooves or channels of the two connectors. The O-rings have the double function of serving as sealing and as acoustic insulation means. The seal 45 below the diametric passage 27 prevents high pressure fluid from reaching the area under the connector 26 and expelling the fluid from the housing upward. The seal thus ensures a perfect equilibration without the need to provide means for fixing the connector of the recess.

The decoupling sheet 42 can be a sheet made of elastomer, for example, with a thickness of 1 mm and a Shore hardness of 60-70. The sheet could also have a multilayered structure comprising a central layer, for example, made of steel, or at least one layer made of an elastomer, for example, nitrile, adhered to each surface of the central layer made of steel. The two elastomer layers can have different thicknesses for damping different frequency ranges. With regard to the nitrile, this material is particularly appropriate since it has good properties of acoustic insulation and a high resistance to creep. Naturally, the acoustic decoupling means can be made of any other appropriate material.

With regard to the sealing O-rings 44, 45 between the connector 26 of the front body 16 and the recess 40 of the manifold, to prevent these seals from deforming under the action of the high pressure fluid due to an extrusion effect, it is possible to place in the grooves 46, on each side of the seal, but at least on the low pressure side, a bracing ring 47, as shown in FIG. 11.

To complete the description, it is noted that seals 48 are placed between the contacting surfaces of the pump body and the front support body 16.

FIG. 9 shows another possibility for fixation of the front body 16 to the manifold 17. Instead of ensuring the tightening of the manifold against the body with the help of the nut, one can also provide, for example, four screws 49 that are intended to engage appropriately threaded holes in the body 16, with the interposition of acoustically insulating washers 50 between each screw head and the corresponding supporting surface of the manifold.

According to yet another characteristic of the invention, one could use the outlet connector of the high pressure liquid 26 as a centering device in place of one of the two traditional centering pins.

It is apparent from the description of the invention, which is given as an example, that the means intended to prevent the transmission of vibrations generated by the pump do not further increase the size of the pump and are inexpensive, while ensuring an effective acoustic decoupling, starting at frequencies of 5 kHz and even lower, while the known enclosure insulation takes up much space and its effectiveness is significantly above 10 kHz. It should be noted that in spite of the interposition of the acoustic insulation elements between the support body 16 and the manifold 17, the axial alignment and the correct positioning of the pieces are ensured and stable.

The invention claimed is:

1. An external gear hydraulic pump comprising:

a pump body housing rotating pinions that mutually engage;

a cover;

a pump support forming an outlet manifold for high pressure fluid, wherein the cover and the pump support are located on opposite sides of the pump body; and acoustic insulation for damping vibrations produced by the pinions, the acoustic insulation comprising an acoustic insulation element acoustically decoupling the pump body from the pump support, wherein the pump support includes distinct first and second pieces, the first piece is integrally connected to the pump body and constitutes a support body, and the second piece constitutes the outlet manifold for the high pressure fluid, and the acoustic insulation element is interposed between the first and second pieces so the first and second pieces are not in physical contact with each other.

2. The pump according to claim 1, wherein the support body comprises a face by which the support body rests on a bearing face of the outlet manifold, and the acoustic insulation element comprises a sheet interposed between the face and the bearing face.

3. The pump according to claim 2, wherein the sheet is an elastomeric material.

4. The pump according to claim 2, wherein the acoustic insulation element is a multilayered sheet comprising a metal layer, and elastomer layers attached to opposed sides of the metal layer.

5. The pump according to claim 4, wherein the elastomer layers have different thicknesses.

6. The pump according to claim 3, wherein the elastomer is nitrile rubber.

7. The pump according to claim 2, including a plurality of acoustic insulation elements, wherein the support body comprises connectors that project from the bearing face, the outlet manifold comprises reception recesses for the connectors and having a shape complementary to the connectors, a clearance remains between facing surfaces of the connectors and of the recesses, and the acoustic insulation elements are located between the facing surfaces.

8. The pump according to claim 7, wherein the acoustic insulation elements are O-rings.

9. The pump according to claim 8, including at least one reinforcement ring located next to one of the O-rings, when the O-ring is between media at different pressures, to avoid extrusion of the O-ring.

10. The pump according to claim 7, wherein the support body comprises a threaded connector that extends through a respective recess that passes through the outlet manifold, and the outlet manifold is coupled to the support body with a nut and a ring of an acoustically insulating material that is interposed between the nut and the outlet manifold.

11. The pump according to claim 7, wherein the outlet manifold is coupled to the support body with a plurality of screws that are anchored in the support body, the screws having heads that bear against the outlet manifold via washers of an acoustically insulating material.

12. The pump according to claim 1, wherein the pump body is connected to the support body with bolts that threadedly engage the support body.

13. The pump according to claim 7, wherein the support body comprises a projecting connector that delimits a space for the passage of the high pressure fluid and opens in a peripheral surface at an opening, the acoustic insulation elements are respectively arranged above and below the opening and constitute sealing elements, and the sealing element arranged below the opening, by preventing high pressure fluid from reaching an area under the connector, ensures a balanced position of a front body in the outlet manifold.

14. The pump according to claim 4, wherein the elastomer is nitrile rubber.

15. The pump according to claim 5, wherein the elastomer is nitrile rubber.

* * * * *